US010803790B2

(12) United States Patent
Cho et al.

(10) Patent No.: US 10,803,790 B2
(45) Date of Patent: Oct. 13, 2020

(54) DISPLAY DEVICE

(71) Applicant: Samsung Display Co., Ltd., Yongin-si, Gyeonggi-do (KR)

(72) Inventors: Hyun Min Cho, Yongin-si (KR); Sung Chul Kim, Yongin-si (KR); Hye Yong Chu, Yongin-si (KR); Jong Hyuk Kang, Yongin-si (KR); Dae Hyun Kim, Yongin-si (KR); Keun Kyu Song, Yongin-si (KR); Hyun Deok Im, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/191,306

(22) Filed: Nov. 14, 2018

(65) Prior Publication Data

US 2019/0244559 A1 Aug. 8, 2019

(30) Foreign Application Priority Data

Feb. 8, 2018 (KR) ..... 10-2018-0015620

(51) Int. Cl.
*G09G 3/3208* (2016.01)
*G09G 3/32* (2016.01)

(52) U.S. Cl.
CPC ..... *G09G 3/3208* (2013.01); *G09G 3/32* (2013.01); *G09G 2300/0452* (2013.01); *G09G 2300/0809* (2013.01); *G09G 2300/0823* (2013.01); *G09G 2320/0242* (2013.01)

(58) Field of Classification Search
CPC ..... G09G 3/3208–3258; G09G 3/3216; G09G 3/3225; G09G 2300/0452; G09G 3/3233; G09G 2300/0866; G09G 2310/0256; G09G 3/3258; G09G 2300/0426;
(Continued)

(56) References Cited

U.S. PATENT DOCUMENTS

| | | | |
|---|---|---|---|
| 8,872,214 | B2 | 10/2014 | Negishi et al. |
| 9,112,112 | B2 | 8/2015 | Do et al. |
| 9,659,545 | B2 | 5/2017 | Cho et al. |

(Continued)

FOREIGN PATENT DOCUMENTS

| | | | |
|---|---|---|---|
| KR | 10-1244926 | B1 | 3/2013 |
| KR | 10-1490758 | B1 | 2/2015 |
| KR | 10-2019-0082340 | A | 7/2019 |

OTHER PUBLICATIONS

Lee, Chi Hwan et al.; "Orientation-Controlled Alignment of Axially Modulated pn Silicon Nanowires"; Nano Lett.; 2010; 10; pp. 5116-5122.

*Primary Examiner* — Sanjiv D. Patel
(74) *Attorney, Agent, or Firm* — Lewis Roca Rothgerber Christie LLP

(57) ABSTRACT

A display device includes a plurality of data lines to supply data voltages, a plurality of scan lines to supply scan signals, and a first pixel connected to at least one of the plurality of data lines, and connected to at least one of the plurality of scan lines, the first pixel including a first light-emitting diode of a first color, in which an anode is connected to a first node and a cathode is connected to a reference voltage line, and a second light-emitting diode of a second color that is different from the first color, in which an anode is connected to the reference voltage line, and a cathode is connected to the first node.

19 Claims, 10 Drawing Sheets

(58) Field of Classification Search
CPC ..... G09G 2320/0295; G09G 2320/041; G09G 3/32; G09G 2300/0809
See application file for complete search history.

(56) References Cited

U.S. PATENT DOCUMENTS

| | | | | |
|---|---|---|---|---|
| 9,773,761 | B2 | 9/2017 | Do | |
| 9,934,722 | B2 * | 4/2018 | Kim | G09G 3/3233 |
| 2004/0251820 | A1 * | 12/2004 | Cok | H01L 27/3209 313/506 |
| 2006/0061525 | A1 * | 3/2006 | Kim | G09G 3/3233 345/76 |
| 2007/0114522 | A1 * | 5/2007 | Kwok | G09G 3/3233 257/40 |
| 2010/0308353 | A1 * | 12/2010 | Grabowski | H01L 51/5278 257/89 |
| 2011/0089850 | A1 | 4/2011 | Shibata et al. | |
| 2011/0291115 | A1 * | 12/2011 | Kim | G09G 3/3225 257/88 |
| 2015/0317952 | A1 * | 11/2015 | Ohara | G09G 3/3233 345/213 |
| 2018/0019426 | A1 * | 1/2018 | Im | H01L 51/0512 |
| 2019/0204670 | A1 * | 7/2019 | Park | G09G 3/32 |

* cited by examiner

FIRST IMAGE FRAME

SECOND IMAGE FRAME

DISPLAY DEVICE

CROSS-REFERENCE TO RELATED APPLICATION

This application claims priority to, and the benefit of, Korean patent application 10-2018-0015620 filed on Feb. 8, 2018 in the Korean Intellectual Property Office, the entire disclosure of which is incorporated herein by reference.

BACKGROUND

1. Field

An aspect of the present disclosure relates to a display device.

2. Description of Related Art

With the development of information technologies, the importance of a display device that is a connection medium between a user and information increases. Accordingly, display devices such as a liquid crystal display device, an organic light emitting display device, and a plasma display device are increasingly used.

The display device displays an image by emitting light from light-emitting elements of pixels. However, when each pixel includes only one light-emitting element, an area of each pixel is relatively large, which may make it difficult to achieve a high resolution of the display device.

SUMMARY

Embodiments provide a display device capable of preventing color-breakup while achieving a high resolution because one pixel may include a plurality of light-emitting diodes of a plurality of colors.

According to an aspect of the present disclosure, there is provided a display device including a data driver for supplying data voltages through data lines, a scan driver for supplying scan signals through scan lines, and a first pixel connected to at least one of the data lines, and connected to at least one of the scan lines, the first pixel including a first light-emitting diode of a first color, in which an first electrode is connected to a first node and a second electrode is connected to a reference voltage line, and a second light-emitting diode of a second color that is different from the first color, in which an first electrode is connected to the reference voltage line, and a second electrode is connected to the first node.

The display device may further include a second pixel connected to at least one of the data lines, and connected to at least one of the scan lines, the second pixel including a third light-emitting diode of the first color, in which an first electrode is connected to a second node, and a second electrode is connected to the reference voltage line, and a fourth light-emitting diode of the second color, in which an first electrode is connected to the reference voltage line, and a second electrode is connected to the second node.

A polarity of a first data voltage applied to the first node may be alternated in units of image frames with respect to a reference voltage applied to the reference voltage line, wherein a polarity of a second data voltage applied to the second node is alternated in units of the image frames with respect to the reference voltage, and wherein the polarity of the first data voltage and the polarity of the second data voltage are opposite to each other with respect to the reference voltage in units of the image frames.

The display device may further include a second pixel connected to at least one of the data lines and connected to at least one of the scan lines, the second pixel including a third light-emitting diode of the first color, in which an first electrode is connected to the reference voltage line, and a second electrode is connected to a second node, and a fourth light-emitting diode of the second color, in which an first electrode is connected to the second node, and a second electrode is connected to the reference voltage line.

The display device may further include a third pixel connected to at least one of the data lines, and connected to at least one of the scan lines, the third pixel including a fifth light-emitting diode of a third color that is different from the first color and the second color, in which an first electrode is connected to a third node, and a second electrode is connected to the reference voltage line.

A polarity of a first data voltage applied to the first node may be alternated in units of image frames with respect to a reference voltage applied to the reference voltage line, wherein a polarity of a second data voltage applied to the second node is alternated in units of the image frames with respect to the reference voltage, and wherein the polarity of the first data voltage and the polarity of the second data voltage are identical to each other with respect to the reference voltage in units of the image frames.

A polarity of a third data voltage applied to the third node may be identically maintained in units of the image frames with respect to the reference voltage.

According to an aspect of the present disclosure, there is provided a display device including a data driver for supplying data voltages through data lines, a scan driver for supplying scan signals through scan lines, and a first pixel connected to at least one of the data lines, and connected to at least one of the scan lines, the first pixel including a first light-emitting diode of a first color, in which a second electrode is connected to a first power voltage line, and an first electrode is connected to a second power voltage line, and a second light-emitting diode of a second color that is different from the first color, in which a second electrode is connected to the second power voltage line, and an first electrode is connected to the first power voltage line.

The display device may further include a second pixel connected to at least one of the data lines, and connected to at least one of the scan lines, the second pixel including a third light-emitting diode of the first color, in which a second electrode is connected to the second power voltage line, and an first electrode is connected to the first power voltage line, and a fourth light-emitting diode of the second color, in which a second electrode is connected to the first power voltage line and an first electrode is connected to the second power voltage line.

The display device may further include a third pixel connected to at least one of the plurality of data lines, and connected to at least one of the plurality of scan lines, the third pixel including a fifth light-emitting diode of a third color that is different from the first color and the second color, in which a cathode is connected to a common low voltage line.

Each of the first pixel and the second pixel may further include a first emission control transistor including one electrode connected to the second power voltage line, the other electrode connected to a fifth node, and a gate electrode connected to a first emission control line, and a second emission control transistor including one electrode connected to the first power voltage line, the other electrode connected to the fifth node, and a gate electrode connected to a second emission control line.

Each of the first pixel and the second pixel may further include a first transistor including one electrode connected to a corresponding data line and a gate electrode connected to a corresponding scan line, a second transistor including one electrode connected to a common high voltage line, the other electrode connected to the fifth node, and a gate electrode connected to the other electrode of the first transistor, and a storage capacitor including one electrode connected to the common high voltage line, and the other electrode connected to the gate electrode of the second transistor.

When the first transistor is in a turned-on state, the first emission control transistor and the second emission control transistor may be in a turned-off state.

The display device may further include a first switch to connect the first power voltage line and the common low voltage line, and a second switch to connect the second power voltage line and the common low voltage line.

The first switch and the second switch may be alternately turned on and off in units of image frames.

When the first switch is in a turned-on state, the second switch may be in a turned-off state, and vice versa.

The first emission control transistor and the second emission control transistor may be alternately turned on and off in units of image frames.

When the first emission control transistor is in a turned-on state, the second emission control transistor may be in a turned-off state, and vice versa.

DETAILED DESCRIPTION

Figure 1:
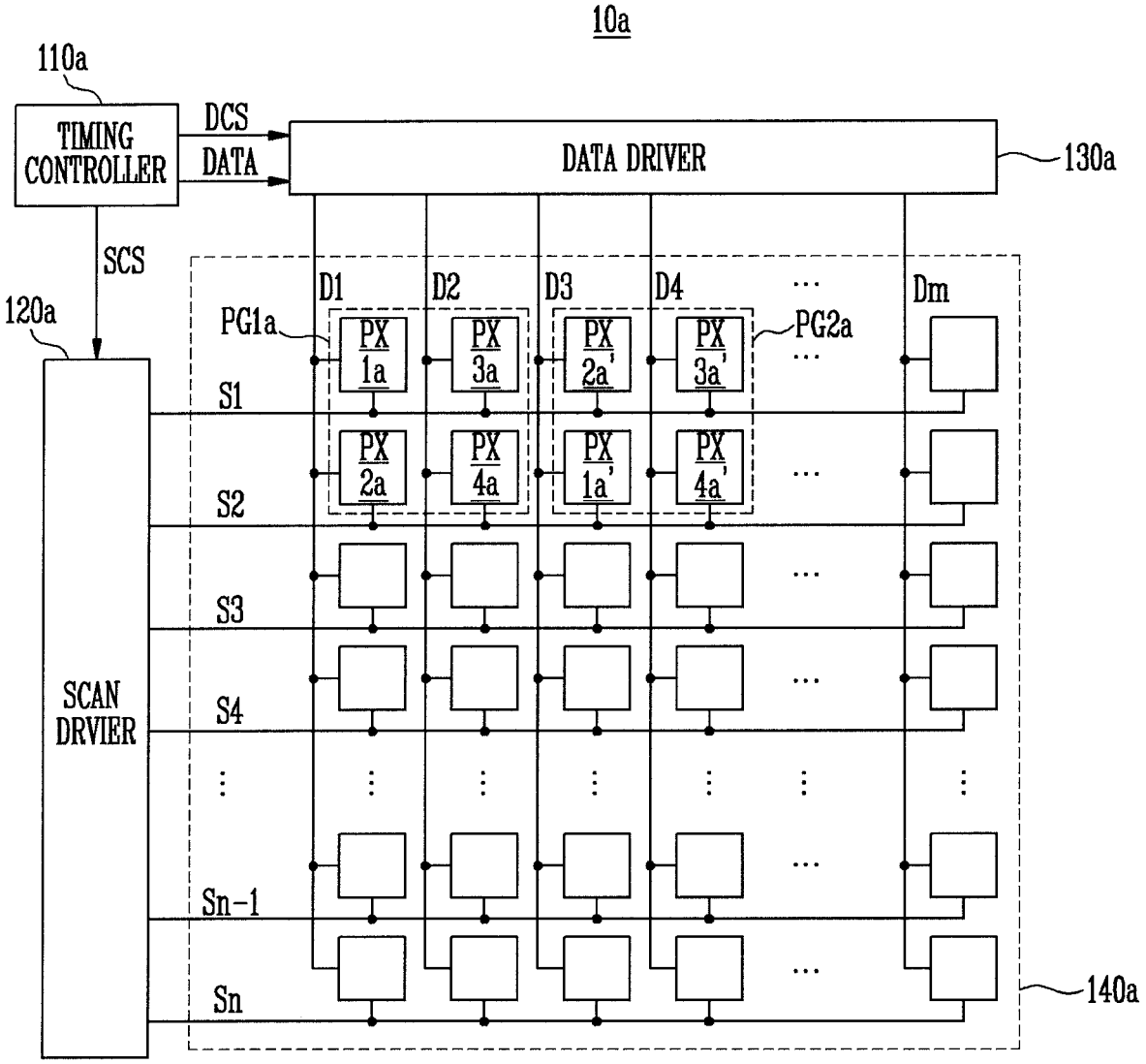
FIG. 1 is a diagram illustrating a display device according to a first embodiment of the present disclosure.

Features of the inventive concept and methods of accomplishing the same may be understood more readily by reference to the following detailed description of embodiments and the accompanying drawings. Hereinafter, embodiments will be described in more detail with reference to the accompanying drawings. The described embodiments, however, may be embodied in various different forms, and should not be construed as being limited to only the illustrated embodiments herein. Rather, these embodiments are provided as examples so that this disclosure will be thorough and complete, and will fully convey the aspects and features of the present inventive concept to those skilled in the art. Accordingly, processes, elements, and techniques that are not necessary to those having ordinary skill in the art for a complete understanding of the aspects and features of the present inventive concept may not be described. Unless otherwise noted, like reference numerals denote like elements throughout the attached drawings and the written description, and thus, descriptions thereof will not be repeated. Further, parts not related to the description of the embodiments might not be shown to make the description clear. In the drawings, the relative sizes of elements, layers, and regions may be exaggerated for clarity.

Various embodiments are described herein with reference to sectional illustrations that are schematic illustrations of embodiments and/or intermediate structures. As such, variations from the shapes of the illustrations as a result, for example, of manufacturing techniques and/or tolerances, are to be expected. Further, specific structural or functional descriptions disclosed herein are merely illustrative for the purpose of describing embodiments according to the concept of the present disclosure. Thus, embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting. Additionally, as those skilled in the art would realize, the described embodiments may be modified in various different ways, all without departing from the spirit or scope of the present invention.

In the following description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. Similarly, when a first part is described as being arranged "on" a second part, this indicates that the first part is arranged at an upper side or a lower side of the second part without the limitation to the upper side thereof on the basis of the gravity direction.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value. Further, the use of "may" when describing embodiments of the present disclosure refers to "one or more embodiments of the present disclosure." As used herein, the terms "use," "using," and "used" may be considered synonymous with the terms "utilize," "utilizing," and "utilized," respectively. Also, the term "exemplary" is intended to refer to an example or illustration.

When a certain embodiment may be implemented differently, a specific process order may be performed differently from the described order. For example, two consecutively described processes may be performed substantially at the same time or performed in an order opposite to the described order.

Also, any numerical range disclosed and/or recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein, and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein. All such ranges are intended to be inherently described in this specification such that amending to expressly recite any such subranges would comply with the requirements of 35 U.S.C. § 112(a) and 35 U.S.C. § 132(a).

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present disclosure.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a diagram illustrating a display device 10*a* according to a first embodiment of the present disclosure.

Referring to FIG. 1, a display device 10*a* according to the first embodiment of the present disclosure includes a timing controller 110*a*, a scan driver 120*a*, a data driver 130*a*, and a display unit 140*a*.

The timing controller 110*a* receives an image signal and an image control signal from a host system, such as an external application processor (AP). For example, the image signal may include a red image signal, a green image signal, a blue image signal, and the like. For example, the image control signal may include a data enable signal, a vertical synchronization signal, a horizontal synchronization signal, and the like. The data enable signal may be an indicator indicating whether the image signal is transmitted or not. The vertical synchronization signal may be an indicator indicating the start or end of the image frame constituting each viewpoint of a moving picture. The horizontal synchronization signal may be an indicator for indicating the start or end of each pixel row constituting the image frame.

The timing controller 110*a* may convert the image signal and the image control signal into a data signal DATA, a data control signal DCS, a scan control signal SCS, or the like according to specifications of the data driver 130*a* and the scan driver 120*a*. The timing controller 110*a* may transmit the data signal DATA and the data control signal DCS to the data driver 130*a*, and may transmit the scan control signal SCS to the scan driver 120*a*.

The scan driver 120*a* supplies scan signals through scan lines S1, S2, S3, S4, . . . , Sn−1, and Sn to the respective pixel rows of the display unit 140*a*. The scan driver 120*a* may be composed of scan stage circuits connected in the form of a shift register. Each scan stage circuit may be connected to a corresponding scan line S1 to Sn. The scan control signal SCS may include, for example, a clock signal and a scan start signal. When the first scan stage circuit operates in accordance with the clock signal responding to the scan start signal as a start point to generate a scan signal of a turn-on level, each of the second scan stage circuit and the subsequent scan stage circuits generates a scan signal responding to the scan signal of the turn-on level of the previous scan stage circuit as the scan start signal. The scan signal of the turn-on level refers to a scan signal of a voltage level capable of turning on a scan transistor of each pixel.

The data driver 130*a* supplies data voltages to the pixel columns of the display unit 140*a* through data lines D1, D2, D3, D4, . . . , and Dm. The data control signal DCS may include, for example, a clock signal, a sampling start signal, a data output signal, or the like. The data driver 130*a* may sample the received data signal DATA in accordance with the clock signal responding to the sampling start signal as a start point, may convert the data signal DATA into the corresponding data voltages in accordance with the specification of the display unit 140*a*, and may sequentially output the data voltages in units of pixel rows responding to the data output signal.

The display unit 140*a* includes pixels connected to at least one of the data lines D1 to Dm and at least one of the scan lines S1 to Sn. By the scan signal of the turn-on level, pixels of the pixel row connected to the corresponding scan line are selected, and the data voltages are input to the selected pixels so that the selected pixels emit light at the corresponding grayscales.

In the embodiment, the pixels of the display unit 140*a* may be grouped into pixel groups PG1*a*, PG2*a*, . . . . Each pixel group may include the same number of pixels. For example, the first pixel group PG1*a* includes a first pixel PX1*a*, a second pixel PX2*a*, a third pixel PX3*a*, and a fourth pixel PX4*a*, and the second pixel group PG2*a* includes a first pixel PX1*a*', a second pixel PX2*a*', a third pixel PX3*a*', and a fourth pixel PX4*a*'. The first pixels PX1*a* and PX1*a*' of the pixel groups PG1*a* and PG2*a* may have the same pixel circuit structure as one another. Furthermore, the second pixels PX2*a* and PX2*a*' of the pixel groups PG1*a* and PG2*a* may have the same pixel circuit structure as one another. The third pixels PX3*a* and PX3*a*' of the pixel groups PG1*a* and PG2*a* may have the same pixel circuit structure as one another. The fourth pixels PX4*a* and PX4*a*' of the pixel groups PG1*a* and PG2*a* may have the same pixel circuit structure as one another.

The first pixel group PG1*a* and the second pixel group PG2*a* may be positioned adjacent to each other. For example, when the display unit 140*a* is in a matrix form, the first pixel group PG1*a* and the second pixel group PG2*a* may be alternately arranged in the row direction, or may be alternately arranged in the column direction.

For example, in FIG. 1, the first pixel group PG1*a* and the second pixel group PG2*a* are alternately arranged in the row direction. The first pixel PX1*a* of the first pixel group PG1*a* and the second pixel PX2*a*' of the second pixel group PG2*a* may be positioned on the same pixel row. That is, the first pixel PX1*a* of the first pixel group PG1*a* and the second pixel PX2*a*' of the second pixel group PG2*a* may be connected to the same scan line S1. The second pixel PX2*a* of the first pixel group PG1*a* and the first pixel PX1*a*' of the second pixel group PG2*a* may be positioned on the same pixel row. That is, the second pixel PX2*a* of the first pixel group PG1*a* and the first pixel PX1*a*' of the second pixel group PG2*a* may be connected to the same scan line S2. According to this arrangement, as will be described below with reference to FIGS. 7 and 8, the first to third colors emit light at the same time to prevent the color-breakup phenomenon.

Hereinafter, for convenience of explanation, a pixel circuit structure and a driving method of each of the pixels PX1*a*, PX2*a*, PX3*a*, and PX4*a* will be described with reference to the first pixel group PG1*a*.

Figure 2:
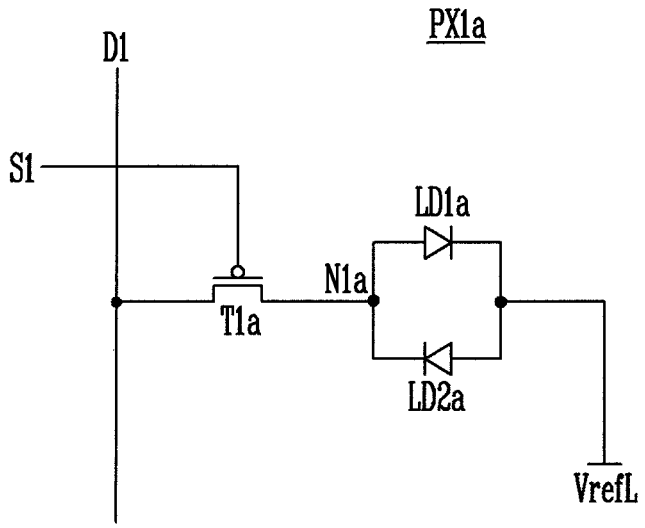
FIG. 2 is a diagram illustrating a first pixel of the first embodiment.

FIG. 2 is a diagram illustrating a first pixel of the first embodiment.

Referring to FIG. 2, the first pixel PX1*a* includes a transistor T1*a* and light-emitting diodes LD1*a* and LD2*a*.

In the transistor T1*a*, one electrode is connected to the data line D1, the other electrode is connected to a first node N1*a*, and the gate electrode is connected to the scan line S1. The transistor T1*a* may be referred to as a scan transistor.

In the first light-emitting diode LD1*a*, the first electrode (e.g., an anode) is connected to the first node N1*a*, and the second electrode (e.g., a cathode is connected to a reference voltage line VrefL. The first light-emitting diode LD1*a* is a light-emitting diode of a first color.

In the second light-emitting diode LD2*a*, the first electrode is connected to the reference voltage line VrefL, and the second electrode is connected to the first node N1*a*. The second light-emitting diode LD2*a* is a light-emitting diode of a second color.

The first color and the second color may be different colors from each other. The color may be defined by an emission wavelength, a bandgap of the light-emitting diode, or the like. For example, if the first color is green, the second color may be blue or red. Similarly, if the first color is red, the second color may be blue or green, and if the first color is blue, the second color may be green or red. Each color can be determined differently depending on the product.

As shown in FIG. 2, only one light-emitting diode for each color is included. However, in another embodiment, the first pixel PX1*a* may include a plurality of light-emitting diodes for each color. For example, the first pixel PX1*a* may include a plurality of first light-emitting diodes of the first color. Each first electrode of the plurality of first light-emitting diodes may be connected to the first node N1*a*, and each second electrode of the plurality of first light-emitting diodes may be connected to the reference voltage line VrefL, so that the plurality of first light-emitting diodes are arranged in parallel with each other. Similarly, the first pixel PX1*a* may include a plurality of second light-emitting diodes of the second color. Each first electrode of the plurality of second light-emitting diodes may be connected to the reference voltage line VrefL, and each second electrode of the plurality of second light-emitting diodes may be connected to the first node N1*a*, so that the plurality of second light-emitting diodes are arranged in parallel with each other.

The light-emitting diodes may be nano light-emitting diodes (nano-LEDs). The nano-LED, for example, has a size of several microns, so that about 10 to about 20 nano-LEDs may be arranged per pixel. The material of the nano-LED may be similar to that of general LEDs. For example, a plurality of nano-LEDs may be fabricated from one LED wafer by sequentially stacking a non-doped GaN layer, a GaN layer doped with n-type impurities, a quantum well, and a GaN layer doped with p-type impurities on a sapphire substrate, or the like, and by then etching and separating them. These nano-LEDs may be dispersed in a solvent and made into a nano-LED ink, and they may then be applied to a pixel circuit by using a slit coating or an inkjet printing method. An appropriate electric field may be applied to the pixel circuit to align the nano LEDs in the desired polarity direction.

In FIG. 2 and the following drawings, an exemplary pixel is described using a P-type transistor. However, those skilled in the art will be able to design a pixel that performs the same function as the present disclosure by using an N-type transistor or by using both an N-type transistor and a P-type transistor. The P-type transistor refers to the transistors that are turned on when a voltage that is lower than that at the source electrode is applied to the gate electrode, and the N-type transistor refers to the transistors that are turned on when a voltage that is higher than that at the source electrode is applied to the gate electrode.

Figure 3:
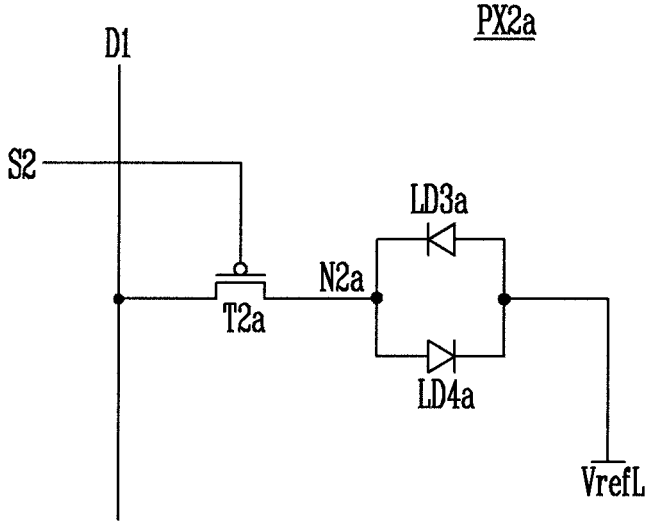
FIG. 3 is a diagram illustrating a second pixel of the first embodiment.

FIG. 3 is a diagram illustrating a second pixel of the first embodiment.

Referring to FIG. 3, the second pixel PX2*a* includes a transistor T2*a* and light-emitting diodes LD3*a* and LD4*a*.

In the transistor T2*a*, one electrode is connected to the data line D1, the other electrode is connected to a second node N2*a*, and the gate electrode is connected to the scan line S2. The transistor T2*a* may be referred to as a scan transistor.

In the third light-emitting diode LD3*a*, the first electrode is connected to the reference voltage line VrefL and the second electrode is connected to the second node N2*a*. The third light-emitting diode LD3*a* is a light-emitting diode of the first color.

In the fourth light-emitting diode LD4*a*, the first electrode is connected to the second node N2*a*, and the second electrode is connected to the reference voltage line VrefL. The fourth light-emitting diode LD4*a* is a light-emitting diode of the second.

As shown in FIG. 3, only one light-emitting diode for each color is included. However, in another embodiment, the second pixel PX2*a* may include a plurality of light-emitting diodes for each color. For example, the second pixel PX2*a* may include a plurality of third light-emitting diodes of the first color. Each second electrode of the plurality of third light-emitting diodes may be connected to the second node N2*a*, and each first electrode of the plurality of third light-emitting diodes may be connected to the reference voltage line VrefL, so that the plurality of third light-emitting diodes are arranged in parallel with each other. Similarly, the second pixel PX2*a* may include a plurality of fourth light-emitting diodes of the second color. Each second electrode of the plurality of fourth light-emitting diodes may be connected to the reference voltage line VrefL, and each first electrode of the plurality of fourth light-emitting diodes may be connected to the second node N2*a*, so that the plurality of fourth light-emitting diodes are arranged in parallel with each other. The light-emitting diodes may be nano-LEDs.

Figure 4:
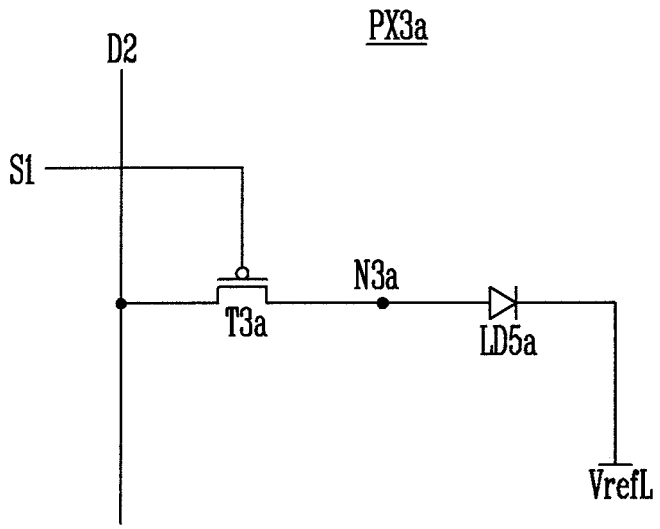
FIG. 4 is a diagram illustrating a third pixel of the first embodiment.

FIG. 4 is a diagram illustrating a third pixel of the first embodiment.

Referring to FIG. 4, the third pixel PX3*a* includes a transistor T3*a* and a fifth light-emitting diode LD5*a*.

In the transistor T3*a*, one electrode is connected to the data line D2, the other electrode is connected to a third node N3*a*, and the gate electrode is connected to the scan line S1. The transistor T3*a* may be referred to as a scan transistor.

In the fifth light-emitting diode LD5*a*, the first electrode is connected to the third node N3*a*, and the second electrode is connected to the reference voltage line VrefL. The fifth light-emitting diode LD5*a* is a light-emitting diode of a third color.

The third color is different from the first color and the second color. For example, if the third color is blue, the first color and the second color may be green and red, or red and green. Similarly, when the third color is green, the first color and the second color may be blue and red, or red and blue. Similarly, when the third color is red, the first color and the second color may be green and blue, or blue and green.

As shown in FIG. 4, only one light-emitting diode for the third color is included. However, in another embodiment, the third pixel PX3*a* may include a plurality of fifth light-emitting diodes of the third color. Each first electrode of the plurality of fifth light-emitting diodes may be connected to the third node N3*a*, and each second electrode of the plurality of fifth light-emitting diodes may be connected to the reference voltage line VrefL, so that the plurality of fifth light-emitting diodes are arranged in parallel with each other. The fifth light-emitting diodes may be the nano-LEDs.

Figure 5:
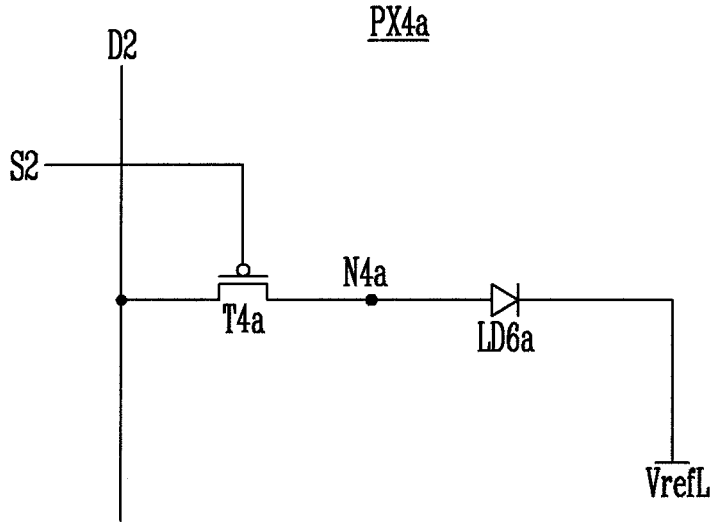
FIG. 5 is a diagram illustrating a fourth pixel of the first embodiment.

FIG. 5 is a diagram illustrating a fourth pixel of the first embodiment.

Referring to FIG. 5, the fourth pixel PX4*a* includes a transistor T4*a* and a sixth light-emitting diode LD6*a*.

In the transistor T4*a*, one electrode is connected to the data line D2, the other electrode is connected to a fourth node N4*a*, and the gate electrode is connected to the scan line S2. The transistor T4*a* may be referred to as a scan transistor.

In the sixth light-emitting diode LD6*a*, the first electrode is connected to the fourth node N4*a*, and the second electrode is connected to the reference voltage line VrefL. The sixth light-emitting diode LD6*a* is a light-emitting diode of the third color.

As shown in FIG. 5, only one light-emitting diode for the third color is included. However, in another embodiment, the fourth pixel PX4*a* may include a plurality of sixth light-emitting diodes of the third color. Each first electrode of the plurality of sixth light-emitting diodes may be connected to the fourth node N4*a*, and each second electrode of the plurality of sixth light-emitting diodes may be connected to the reference voltage line VrefL, so that the plurality of sixth light-emitting diodes are arranged in parallel with each other. The sixth light-emitting diodes may be the nano-LEDs.

Figure 6:
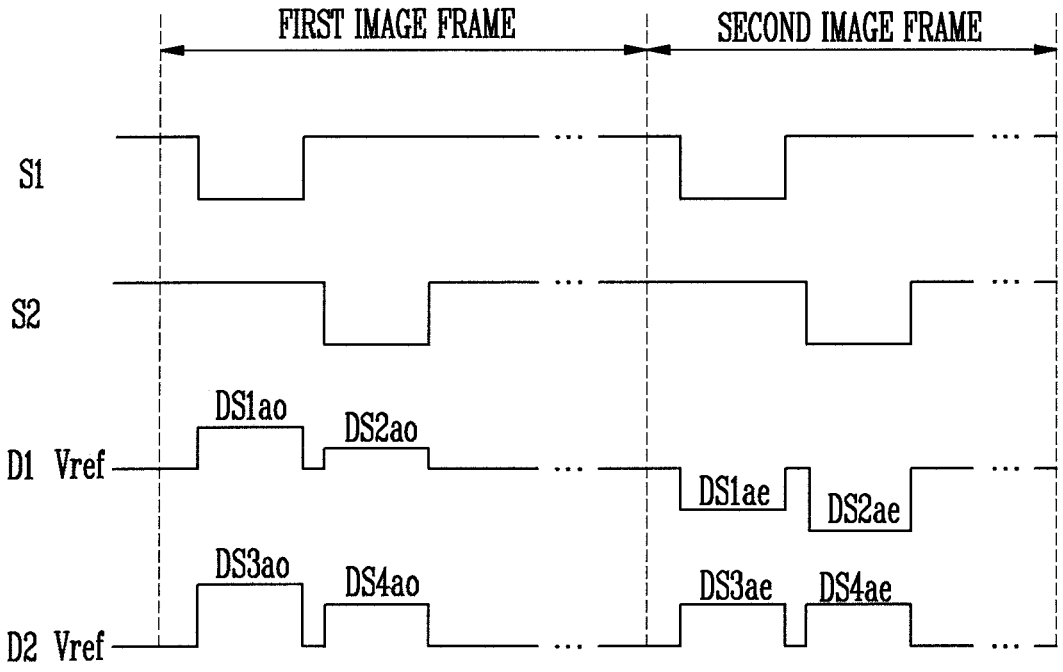
FIG. 6 is a diagram illustrating a driving method of the display device of the first embodiment.
Figure 7:
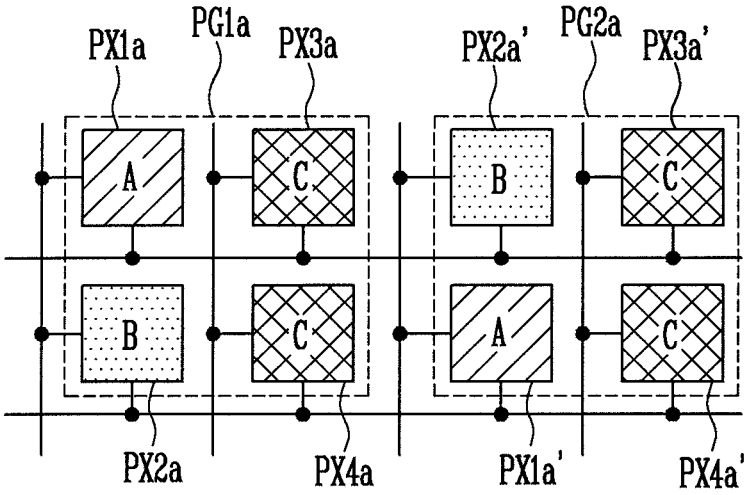
FIG. 7 is a diagram illustrating emission colors of the first to fourth pixels in a first image frame.
Figure 8:
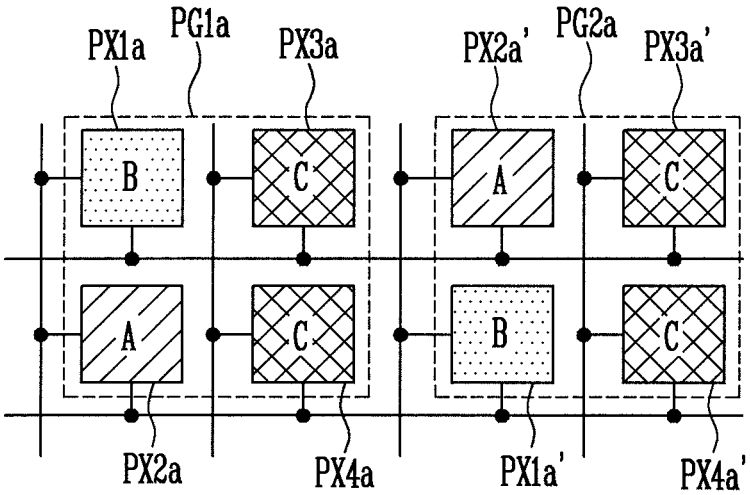
FIG. 8 is a diagram illustrating emission colors of the first to fourth pixels in a second image frame.

FIG. 6 is a diagram illustrating a driving method of the display device of the first embodiment. FIG. 7 is a diagram illustrating emission colors of the first to fourth pixels in a first image frame. FIG. 8 is a diagram illustrating emission colors of the first to fourth pixels in a second image frame.

Hereinafter, only the signals applied to the first to fourth pixels PX1*a* to PX4*a* of the first pixel group PG1*a* in two image frames will be described for convenience of explanation.

The first image frame may be an odd image frame, and the second image frame may be an even image frame. Therefore, the display device 10*a* may display an image to the user by displaying the first image frame and the second image frame alternately over time.

First, in the first image frame, the scan signal of the turn-on level (low level) is supplied through the scan line S1. Thus, the transistor T1*a* of the first pixel PX1*a* is turned on to connect the data line D1 and the first node N1*a*, and the transistor T3*a* of the third pixel PX3*a* is turned on to connect the data line D2 and the third node N3*a*.

Accordingly, a data voltage DS1*ao* applied to the data line 01 is applied to the first electrode of the first light-emitting diode LD1*a* of the first pixel PX1*a*, and a reference voltage Vref applied to the reference voltage line VrefL is applied to the second electrode of the first light-emitting diode LD1*a*. Because the polarity of the data voltage DS1*ao* is positive with respect to the reference voltage Vref, the first light-emitting diode LD1*a* emits light at a grayscale corresponding to the potential difference between the data voltage DS1*ao* and the reference voltage Vref.

On the other hand, because the reference voltage Vref is applied to the first electrode of the second light-emitting diode LD2*a* of the first pixel PX1*a*, and the data voltage DS1*ao* of the positive polarity with respect to the reference voltage Vref is applied to the second electrode of the second light-emitting diode LD2*a*, a reverse voltage is applied to the second light-emitting diode LD2*a*, and no light is emitted from the second light-emitting diode LD2*a*.

Accordingly, the first pixel PX1*a* of the first image frame emits light of a first color A.

Also, a data voltage DS3*ao* applied to the data line D2 is applied to the first electrode of the fifth light-emitting diode LD5*a* of the third pixel PX3*a*, and the reference voltage Vref applied to the reference voltage line VrefL is applied to the second electrode of the fifth light-emitting diode LD5*a*. Therefore, the fifth light-emitting diode LD5*a* emits light at a grayscale corresponding to the potential difference between the data voltage DS3*ao* and the reference voltage Vref.

Accordingly, the third pixel PX3*a* of the first image frame emits light of a third color C.

Next, in the first image frame, the scan signal of the turn-on level (low level) is supplied through the scan line S2. The transistor T2*a* of the second pixel PX2*a* is turned on to connect the data line D1 to the second node N2*a*, and the transistor T4*a* of the fourth pixel PX4*a* is turned on to connect the data line D2 and the fourth node N4*a*.

Therefore, the data voltage DS2*ao* applied to the data line D1 is applied to the first electrode of the fourth light-emitting diode LD4*a* of the second pixel PX2*a*, and the reference voltage Vref applied to the reference voltage line VrefL is applied to the second electrode of the fourth light-emitting diode LD4*a*. Because the polarity of the data voltage DS2*ao* is positive with respect to the reference voltage Vref, the fourth light-emitting diode LD4*a* emits light at a grayscale corresponding to the potential difference between the data voltage DS2*ao* and the reference voltage Vref.

On the other hand, the reference voltage Vref is applied to the first electrode of the third light-emitting diode LD3*a* of the second pixel PX2*a*, and the data voltage DS2*ao* of the positive polarity with respect to the reference voltage Vref is applied to the second electrode of the third light-emitting diode LD3*a*, so that a reverse voltage is applied to the third light-emitting diode LD3*a*, and no light is emitted from the third light-emitting diode LD3*a*.

Accordingly, the second pixel PX2*a* of the first image frame emits light of a second color B.

On the other hand, the data voltage DS4*ao* applied to the data line D2 is applied to the first electrode of the sixth light-emitting diode LD6*a* of the fourth pixel PX4*a*, and the reference voltage Vref applied to the reference voltage line VrefL. Therefore, the sixth light-emitting diode LD6*a* emits light at a grayscale corresponding to the potential difference between the data voltage DS4*ao* and the reference voltage Vref.

Accordingly, the fourth pixel PX4*a* of the first image frame emits light of the third color C.

Similarly, in the first image frame, the first pixel PX1*a*' of the second pixel group PG2*a* emits light of the first color A, the second pixel PX2*a*' emits light of the second color B, the third pixel PX3*a*' emits light of the third color C, and the fourth pixel PX4*a*' emits light of the third color C.

According to the present embodiment, because light of the first color, the second color, and the third color are concurrently or simultaneously emitted from the pixel groups PG1*a*, PG2*a*, . . . of the first image frame, the color-breakup phenomenon does not occur. The color-breakup phenomenon refers to, for example, among all three colors, light of two or less colors is emitted in one frame, and light of two or fewer different colors is emitted in the next frame, so that the color difference between one frame and the next frame is perceived by the user.

In addition, according to the present embodiment, because the color arrangement of the first pixel group PG1*a* and the color arrangement of the second pixel group PG2*a* that is most adjacent to the first pixel group PG1*a* are vertically opposite to each other, the color-breakup phenomenon may be further prevented.

In addition, according to the embodiment, because each of the first and second pixels includes a plurality of light-emitting diodes of plural colors in one pixel circuit, the total area of the pixel circuits is reduced, so that the display device 10*a* may be manufactured with a higher resolution.

Next, in the second image frame, the scan signal of the turn-on level (low level) is supplied again through the scan line S1. Thus, the transistor T1*a* of the first pixel PX1*a* is turned on to connect the data line D1 and the first node N1*a*, and the transistor T3*a* of the third pixel PX3*a* is turned on to connect the data line D2 and the third node N3*a*.

Therefore, the data voltage DS1*ae* applied to the data line D1 is applied to the first electrode of the first light-emitting diode LD1*a* of the first pixel PX1*a*, and the reference voltage Vref applied to the reference voltage line VrefL is applied to the second electrode of the first light-emitting diode LD1*a*. Because the polarity of the data voltage DS1*ae* is negative with respect to the reference voltage Vref, the first light-emitting diode LD1*a* does not emit light in accordance with the reverse potential difference.

On the other hand, because the reference voltage Vref is applied to the first electrode of the second light-emitting diode LD2*a* of the first pixel PX1*a*, and the data voltage DS1*ae* of the negative polarity with respect to the reference voltage Vref is applied to the second electrode of the second light-emitting diode LD2*a*, the second light-emitting diode LD2*a* emits light at a grayscale corresponding to the potential difference between the reference voltage Vref and the data voltage DS1*ae*.

Accordingly, the first pixel PX1*a* of the second image frame emits light of the second color B. That is, the polarity of the voltage applied to the first node N1*a* is alternated with respect to the reference voltage Vref applied to the reference voltage line VrefL in units of image frames, so that the first pixel PX1*a* emits light of the first color A in the first image frame, and emits light of the second color B in the second image frame.

On the other hand, the data voltage DS3*ae* applied to the data line D2 is applied to the first electrode of the fifth light-emitting diode LD5*a* of the third pixel PX3*a*, and the reference voltage Vref applied to the reference voltage line VrefL is applied to the second electrode of the fifth light-emitting diode LD5*a*. Therefore, the fifth light-emitting diode LD5*a* emits light at a grayscale corresponding to the potential difference between the data voltage DS3*ae* and the reference voltage Vref.

Accordingly, the third pixel PX3*a* of the second image frame emits light of the third color C. That is, the polarity of the voltage applied to the third node N3*a* is maintained with reference to the reference voltage Vref applied to the reference voltage line VrefL in units of image frames, so that the third pixel PX3*a* emits light of the third color C in both the first image frame and the second image frame.

Next, in the second image frame, the scan signal of the turn-on level (low level) is supplied through the scan line S2. The transistor T2*a* of the second pixel PX2*a* is turned on to connect the data line D1 and the second node N2*a*, and the transistor T4*a* of the fourth pixel PX4*a* is turned on to connect the data line D2 and the fourth node N4*a*.

Accordingly, the data voltage DS2*ae* applied to the data line D1 is applied to the first electrode of the fourth light-emitting diode LD4*a* of the second pixel PX2*a*, and the reference voltage Vref applied to the reference voltage line VrefL is applied to the second electrode of the fourth light-emitting diode LD4*a*. Because the polarity of the data voltage DS2*ae* is negative with respect to the reference voltage Vref, the fourth light-emitting diode LD4*a* does not emit light due to a reverse voltage applied thereto.

On the other hand, because the reference voltage Vref is applied to the first electrode of the third light-emitting diode LD3*a* of the second pixel PX2*a* and the data voltage DS2*ae* of the negative polarity with respect to the reference voltage Vref is applied to the second electrode of the third light-emitting diode LD3*a*, the third light-emitting diode LD3*a* emits light at a grayscale corresponding to the potential difference between the reference voltage Vref and the data voltage DS2*ae*.

Accordingly, the second pixel PX2*a* of the second image frame emits light of the first color A. That is, the polarity of the voltage applied to the second node N2*a* is alternated with respect to the reference voltage Vref applied to the reference voltage line VrefL in units of image frames, and the second pixel PX2*a* emits light of the second color B in the first image frame, and emits light of the first color A in the second image frame. According to the embodiment of FIG. 6, the voltage applied to the first node N1*a* and the voltage applied to the second node N2*a* have the same polarity with respect to the reference voltage Vref in units of image frames.

On the other hand, the data voltage DS4*ae* applied to the data line D2 is applied to the first electrode of the sixth light-emitting diode LD6*a* of the fourth pixel PX4*a*, and the reference voltage Vref applied to the reference voltage line VrefL is applied to the second electrode of the sixth light-emitting diode LD6*a*. Accordingly, the sixth light-emitting diode LD6*a* emits light at a grayscale corresponding to the potential difference between the data voltage DS4*ae* and the reference voltage Vref.

Therefore, the fourth pixel PX4*a* of the second image frame emits light of the third color C. That is, the polarity of the voltage applied to the fourth node N4*a* is maintained with respect to the reference voltage Vref applied to the reference voltage line VrefL in units of image frames, so that the fourth pixel PX4*a* emits light of the third color C in both the first image frame and the second image frame.

In a similar manner, in the second image frame, the first pixel PX1*a*' of the second pixel group PG2*a* emits light of the second color B, the second pixel PX2*a*' emits light of the first color A, the third pixel PX3*a*' emits light of the third color C, and the fourth pixel PX4*a*' emits light of the third color C.

According to the embodiment, because the color arrangement of each of the pixel groups PG1*a* and PG2*a* is vertically reversed in the first image frame and the second image frame, it is possible to further prevent the occurrence of the color-breakup phenomenon.

Figure 9:
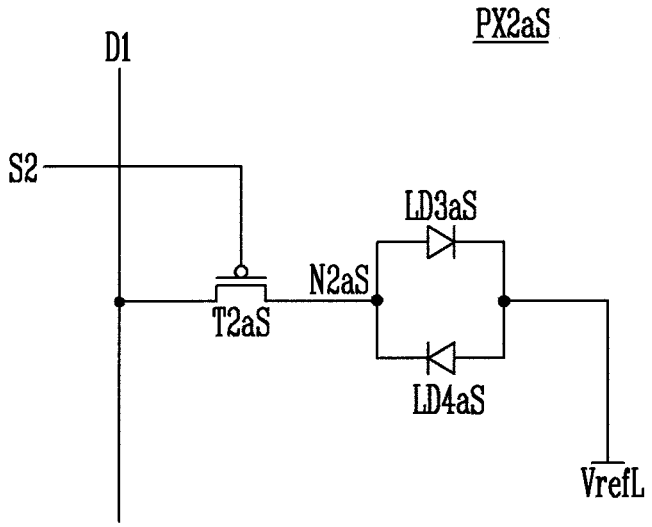
FIG. 9 is a diagram illustrating an example in which the second pixel of the first embodiment is configured differently.

FIG. 9 is a diagram illustrating an example in which the second pixel of the first embodiment is configured differently from the first pixel of the first embodiment.

Referring to FIG. 9, the second pixel PX2*a*S includes a transistor T2*a*S and light-emitting diodes LD3*a*S and LD4*a*S.

In the transistor T2*a*S, one electrode is connected to the data line D1, the other electrode is connected to the second node N2*a*S, and the gate electrode is connected to the scan line S2. The transistor T2*a*S may be referred to as a scan transistor.

In the third light-emitting diode LD3*a*S, unlike the embodiment of FIG. 3, the first electrode is connected to the second node N2*a*S, and the second electrode is connected to the reference voltage line VrefL.

In addition, unlike the embodiment of FIG. 3, the fourth light-emitting diode LD4*a*S has an first electrode connected to the reference voltage line VrefL, and a second electrode connected to the second node N2*a*S.

That is, the second pixel PX2*a*S of FIG. 9 may have substantially the same pixel circuit structure as the first pixel PX1*a*. However, because the driving method of FIG. 6 is not applicable thereto, a new driving method will be described below with reference to FIG. 10.

Figure 10:
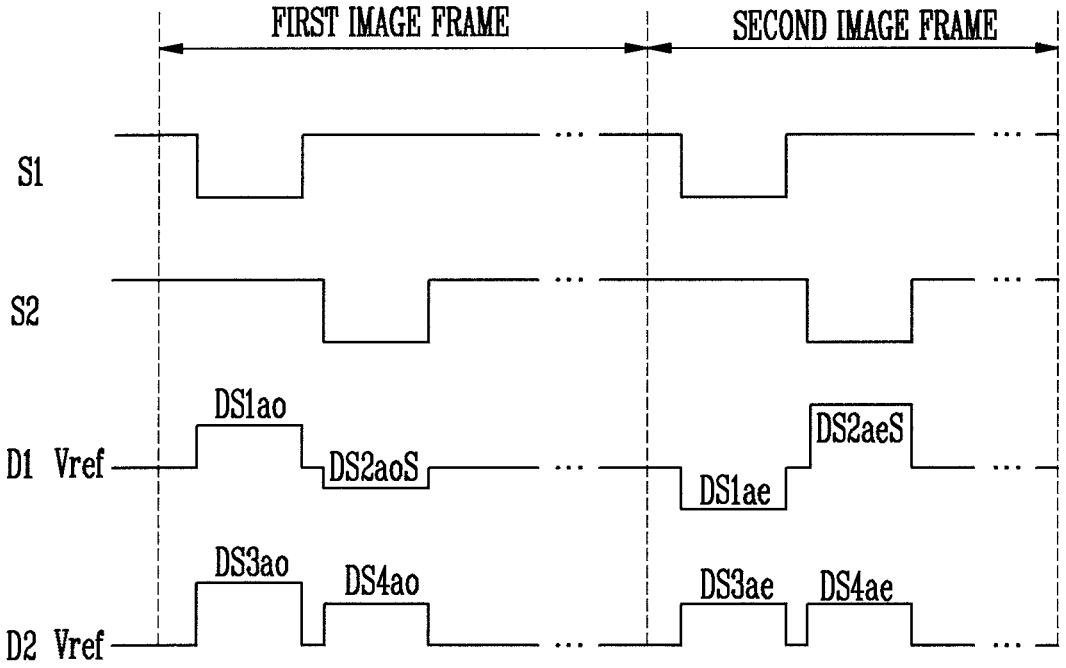
FIG. 10 is a diagram illustrating a driving method using the second pixel according to the embodiment of FIG. 9.

FIG. 10 is a diagram illustrating a driving method using the second pixel according to the embodiment of FIG. 9.

The driving method of FIG. 10 is different from the driving method of FIG. 6 in terms of the polarity of the data voltage DS2*ao*S applied to the data line D1 corresponding to the second pixel PX2*a*S in the first image frame, and in terms of the polarity of the data voltage DS2*ae*S applied to the data line D1 corresponding to the second pixel PX2*a*S in the second image frame.

That is, in FIG. 10, although the polarity of the voltage applied to the first node N1*a* and the polarity of the voltage applied to the second node N2*a*S are alternated with respect to the reference voltage Vref applied to the reference voltage line VrefL in units of image frames, the polarity of the voltage applied to the first node N1*a* and the polarity of the voltage applied to the second node N2*a*S are opposite to each other with respect to the reference voltage Vref in units of image frames.

Even if the second pixel PX2*a*S is designed using the embodiment of FIG. 9, by using the driving method of FIG. 10, each pixel group PG1*a*, PG2*a*, . . . may emit light as shown in FIGS. 7 and 8. Therefore, even in this case, it is possible to ensure the resolution of the display device 10*a*, and to reduce or prevent the color-breakup phenomenon.

As described above, even if the second pixel PX2*a*S of FIG. 9 is configured by reversing the connection direction of the light-emitting diodes of the respective colors in the second pixel PX2*a* of FIG. 3, it is possible to drive the second pixel PX2*a*S by reversing the polarity of the data voltage as described in FIG. 10. According to another embodiment, it is possible to configure the connection directions of the light-emitting diodes of the respective colors in the first pixel PX1*a*, the third pixel PX3*a*, or the fourth pixel PX4*a* to be reversed, and to drive the pixels PX1*a*, PX3*a*, or PX4*a* by inverting the polarity of the corresponding data voltage.

Figure 11:
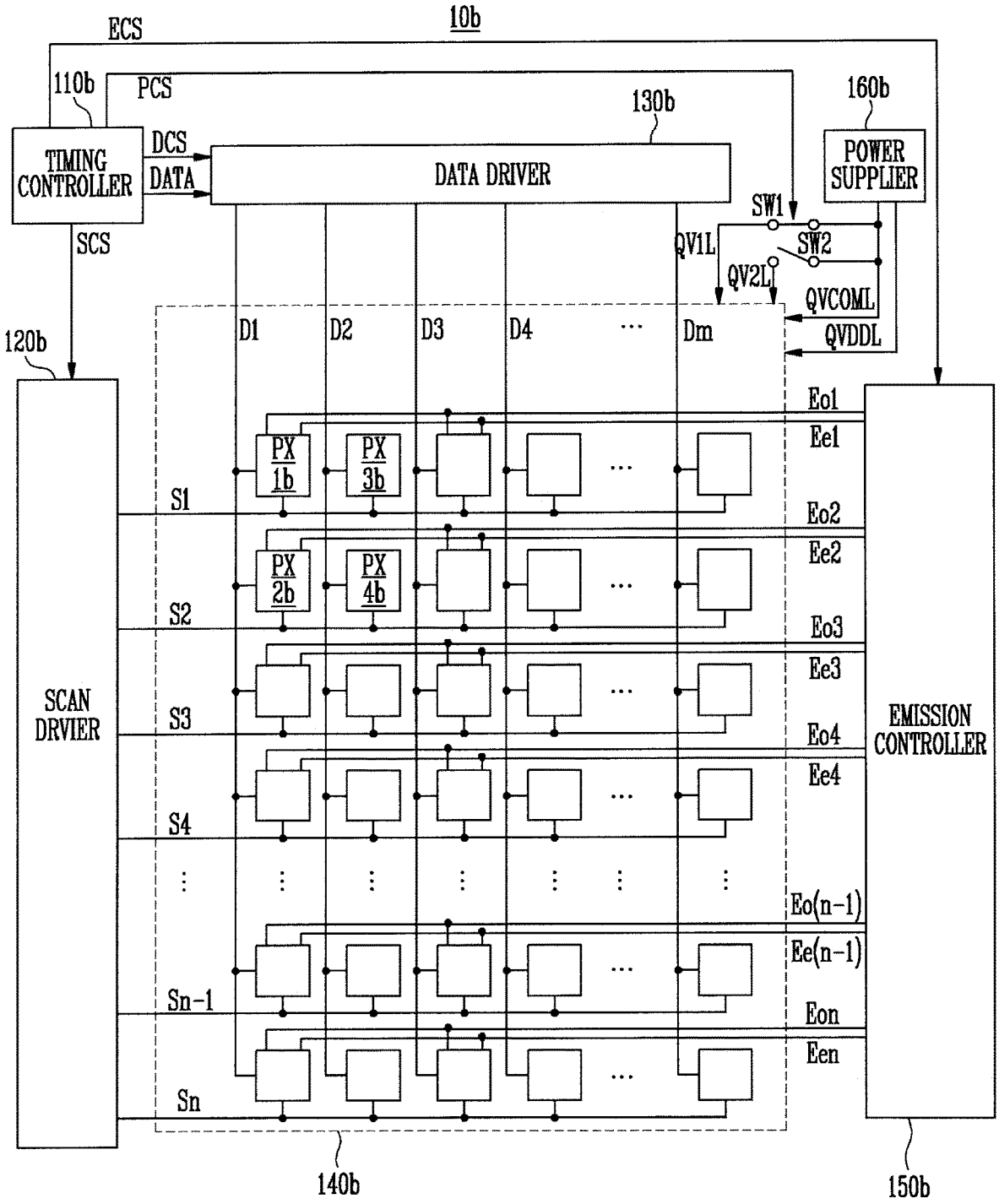
FIG. 11 is a diagram illustrating a display device according to a second embodiment of the present disclosure.

FIG. 11 is a diagram illustrating a display device according to a second embodiment of the present disclosure.

Referring to FIG. 11, a display device 10*b* according to the second embodiment of the present disclosure includes a timing controller 110*b*, a scan driver 120*b*, a data driver 130*b*, a display unit 140*b*, an emission controller 150*b*, and a power supplier 160*b*.

Comparing the display device 10*b* of the second embodiment of FIG. 11 with the display device 10*a* of the first embodiment of FIG. 1, the display device 10*b* further includes the emission controller 150*b* and the power supplier 160*b*. Hereinafter, the repeated description related to FIG. 1 will be omitted, and differences between the display devices of the first and second embodiments will be mainly described.

The timing controller 110*b* further generates an emission control signal ECS and a power control signal PCS. The emission control signal ECS is transmitted to the emission controller 150*b*, and the power control signal PCS is transmitted to a first switch SW1 and a second switch SW2. Although the power supplier 160*b* and the switches SW1 and SW2 are separately shown in the present embodiment to clearly show the operation of the device, the switches SW1 and SW2 may also be interpreted as a part of the power supplier 160*b*. The power control signal PCS may be expressed as being transmitted to the power supplier 160*b*.

The emission controller 150*b* is connected to the display unit 140*b* through first emission control lines Eo1, Eo2, Eo3, Eo4, . . . , Eo(n−1), and Eon, and through second emission control lines Ee1, Ee2, Ee3, Ee4, . . . , Ee(n−1), and Een. The first emission control lines Eo1 to Eon and the second emission control lines Ee1 to Een are connected to the first and second pixels PX1*b*, PX2*b*, . . . including a plurality of light-emitting diodes of a plurality of colors. In the present embodiment, the emission control lines are not connected to the third and fourth pixels PX3*b*, PX4*b*, . . . including single-color light-emitting diodes. However, in another embodiment, the emission control lines may be connected to the third and fourth pixels PX3*b*, PX4*b*, . . . so as to clearly distinguish between the data writing period and the light emitting period.

The power supplier 160*b* supplies power voltages to the display unit 140*b*. The power supplier 160*b* supplies a common low voltage via a common low voltage line QVCOML, and supplies a common high voltage via a common high voltage line QVDDL. In the present embodiment, each of the voltage lines QVCOML and QVDDL supplies a single level voltage for the sake of convenience. However, in another embodiment, the voltage levels of the voltage lines QVCOML and QVDDL may be adjusted in accordance with a luminance condition, a grayscale condition, a temperature condition, or the like to reduce power consumption.

Additionally, a first power voltage line QV1L and a second power voltage line QV2L are also connected to the display unit 140*b*. The first power voltage line QV1L is connected to the common low voltage line QVCOML through the first switch SW1, and the second power voltage line QV2L is connected to the common low voltage line QVCOML through the second switch SW2.

The first switch SW1 and the second switch SW2 are controlled to be ON/OFF in accordance with the power control signal PCS. The first switch SW1 and the second switch SW2 are alternately turned on and off in units of image frames. For example, when the first switch SW1 is turned on in the first image frame, the second switch SW2 is turned off, and when the second switch SW2 is turned on in the second image frame, the first switch SW1 is turned off. The switch turned on among the switches SW1 and SW2 connects the corresponding power voltage line QV1L or QV2L and the common low voltage line QVCOML, so that the common low voltage is applied to the corresponding power voltage line QV1L or QV2L. Because the switch that is turned off separates the other power voltage line QV1L or QV2L and the common low voltage line QVCOML, the other power voltage line QV1L or QV2L is floated, so that one end of the other power voltage line QV1L or QV2L may be interpreted to be connected to the high impedance Hi-Z. See also FIG. 16.

Figure 12:
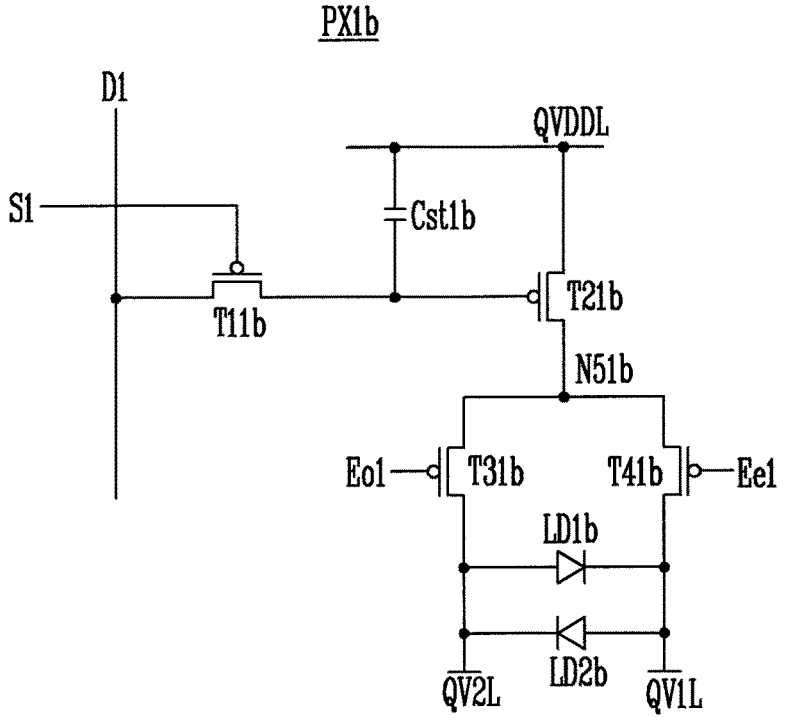
FIG. 12 is a diagram illustrating a first pixel of the second embodiment.

FIG. 12 is a diagram illustrating a first pixel of the second embodiment.

Referring to FIG. 12, the first pixel PX1*b* of the second embodiment includes transistors T11*b*, T21*b*, T31*b*, and T41*b*, a storage capacitor Cst1*b*, and light-emitting diodes LD1*b* and LD2*b*.

In the transistor T11*b*, one electrode is connected to the data line D1, the other electrode is connected to the gate electrode of the transistor T21*b*, and the gate electrode is connected to the scan line S1. The transistor T11*b* may be referred to as a scan transistor.

In the transistor T21*b*, one electrode is connected to the common high voltage line QVDDL, the other electrode is connected to a fifth node N51*b*, and the gate electrode is connected to the other electrode of the transistor T11*b*. The transistor T21*b* may be referred to as a driving transistor.

In the storage capacitor Cst1*b*, one electrode is connected to the common high voltage line QVDDL, and the other electrode is connected to the gate electrode of the transistor T21*b*.

In the first emission control transistor T31*b*, one electrode is connected to the second power voltage line QV2L, the other electrode is connected to the fifth node N51*b*, and the gate electrode is connected to the first emission control line Eo1.

In the second emission control transistor T41*b*, one electrode is connected to the first power voltage line QV1L, the other electrode is connected to the fifth node N51*b*, and the gate electrode is connected to the second emission control line Ee1.

In the first light-emitting diode LD1*b*, the second electrode is connected to the first power voltage line QV1L, and the first electrode is connected to the second power voltage line QV2L. The first light-emitting diode LD1*b* may be a light-emitting diode of the first color A.

In the second light-emitting diode LD2*b*, the second electrode is connected to the second power voltage line QV2L, and the first electrode is connected to the first power voltage line QV1L. The second light-emitting diode LD2*b* may be a light-emitting diode of the second color B. As described above, the first color A and the second color B are different colors.

As shown in FIG. 12, only one light-emitting diode for each color is included. However, in other embodiments, the first pixel PX1*b* may include a plurality of light-emitting diodes for each color. For example, the first pixel PX1*b* may include a plurality of first light-emitting diodes of the first color. The plurality of first light-emitting diodes may be arranged parallel to each other such that each second electrode is connected to the first power voltage line QV1L, and each first electrode is connected to the second power voltage line QV2L. Similarly, the first pixel PX1*b* may include a plurality of second light-emitting diodes of the second color. The plurality of second light-emitting diodes may be arranged parallel to each other such that each second electrode is connected to the second power voltage line QV2L, and each first electrode is connected to the first power voltage line QV1L. The light-emitting diodes may be nano-LEDs.

Figure 13:
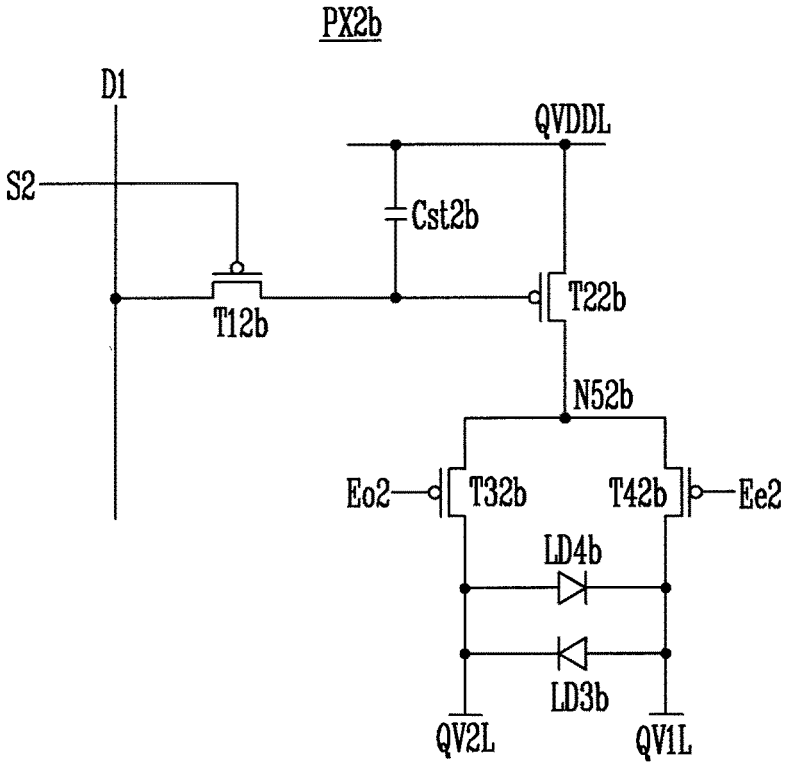
FIG. 13 is a diagram illustrating a second pixel of the second embodiment.

FIG. 13 is a diagram illustrating a second pixel of the second embodiment.

Referring to FIG. 13, the second pixel PX2*b* of the second embodiment includes transistors T12*b*, T22*b*, T32*b*, and T42*b*, a storage capacitor Cst2*b*, and light-emitting diodes LD3*b* and LD4*b*.

In the transistor T12*b*, one electrode is connected to the data line D1, the other electrode is connected to the gate electrode of the transistor T22*b*, and the gate electrode is connected to the scan line S2. The transistor T12*b* may be referred to as a scan transistor.

In the transistor T22*b*, one electrode is connected to the common high voltage line QVDDL, the other electrode is connected to a fifth node N52*b*, and the gate electrode is connected to the other electrode of the transistor T12*b*. The transistor T22*b* may be referred to as a driving transistor.

In the storage capacitor Cst2*b*, one electrode is connected to the common high voltage line QVDDL, and the other electrode is connected to the gate electrode of the transistor T22*b*.

In the first emission control transistor T32*b*, one electrode is connected to the second power voltage line QV2L, the other electrode is connected to the fifth node N52*b*, and the gate electrode is connected to the first emission control line Eo2.

In the second emission control transistor T42*b*, one electrode is connected to the first power voltage line QV1L, the other electrode is connected to the fifth node N52*b*, and the gate electrode is connected to the second emission control line Ee2.

In the third light-emitting diode LD3*b*, the second electrode is connected to the second power voltage line QV2L, and the first electrode is connected to the first power voltage line QV1L. The third light-emitting diode LD3*b* may be a light-emitting diode of the first color A.

In the fourth light-emitting diode LD4*b*, the second electrode is connected to the first power voltage line QV1L, and the first electrode is connected to the second power voltage line QV2L. The fourth light-emitting diode LD4*b* may be a light-emitting diode of the second color B.

As shown in FIG. 13, only one light-emitting diode for each color is included. However, in other embodiments, the second pixel PX2*b* may include a plurality of light-emitting diodes for each color. For example, the second pixel PX2*b* may include a plurality of third light-emitting diodes of the first color. The plurality of third light-emitting diodes may be arranged parallel to each other such that each second electrode is connected to the second power voltage line QV2L, and each first electrode is connected to the first power voltage line QV1L. Similarly, the second pixel PX2*b* may include a plurality of fourth light-emitting diodes of the second color. The plurality of fourth light-emitting diodes may be arranged parallel to each other such that each second electrode is connected to the first power voltage line QV1L, and each first electrode is connected to the second power voltage line QV2L. The light-emitting diodes may be nano-LEDs.

Figure 14:
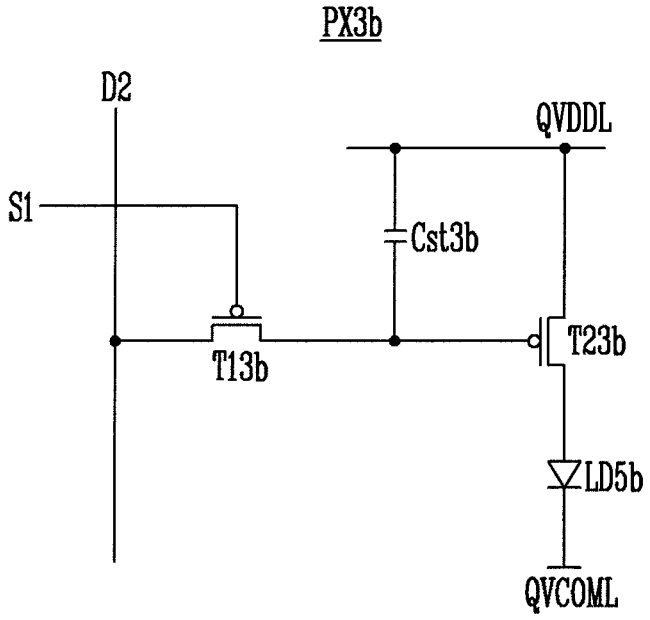
FIG. 14 is a diagram illustrating a third pixel of the second embodiment.

FIG. 14 is a diagram illustrating a third pixel of the second embodiment.

Referring to FIG. 14, the third pixel PX3*b* of the second embodiment includes transistors T13*b* and T23*b*, a storage capacitor Cst3*b*, and a fifth light-emitting diode LD5*b*.

In the transistor T13*b*, one electrode is connected to the data line D2, the other electrode is connected to the gate electrode of the transistor T23*b*, and the gate electrode is connected to the scan line S1. The transistor T13*b* may be referred to as a scan transistor.

In the transistor T23*b*, one electrode is connected to the common high voltage line QVDDL, the other electrode is connected to the anode of the fifth light-emitting diode LD5*b*, and the gate electrode is connected to the other electrode of the storage capacitor Cst3*b*. The transistor T23*b* may be referred to as a driving transistor.

In the storage capacitor Cst3*b*, one electrode is connected to the common high voltage line QVDDL, and the other electrode is connected to the gate electrode of the transistor T23*b*.

In the fifth light-emitting diode LD5*b*, the first electrode is connected to the other electrode of the transistor T23*b*, and the second electrode is connected to the common low voltage line QVCOML. The fifth light-emitting diode LD5*b* may be a light-emitting diode of the third color C. As described above, the third color C is different from the first color A and the second color B.

In FIG. 14, only one fifth light-emitting diode LD5*b* is included. However, in other embodiments, the third pixel PX3*b* may include a plurality of fifth light-emitting diodes for the third color C. The plurality of fifth light-emitting diodes may be arranged parallel with each other such that each first electrode is connected to the other electrode of the transistor T23*b*, and each second electrode is connected to the common low voltage line QVCOML. The light-emitting diodes may be nano-LEDs.

Figure 15:
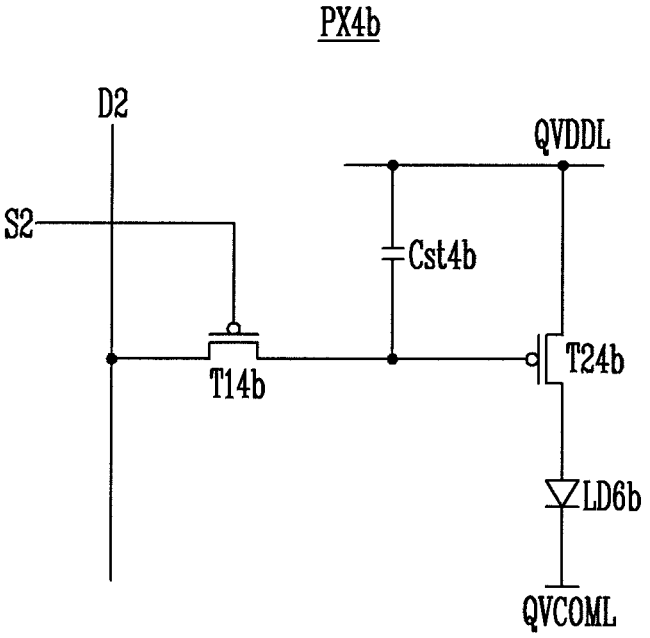
FIG. 15 is a diagram illustrating a fourth pixel of the second embodiment.

FIG. 15 is a diagram illustrating a fourth pixel of the second embodiment.

Referring to FIG. 15, the fourth pixel PX4*b* of the second embodiment includes transistors T14*b* and T24*b*, a storage capacitor Cst4*b*, and a sixth light-emitting diode LD6*b*.

In the transistor T14*b*, one electrode is connected to the data line D2, the other electrode is connected to the gate electrode of the transistor T24*b*, and the gate electrode is connected to the scan line S2. The transistor T14*b* may be referred to as a scan transistor.

In the transistor T24*b*, one electrode is connected to the common high voltage line QVDDL, the other electrode is connected to the first electrode of the sixth light-emitting diode LD6*b*, and the gate electrode is connected to the other electrode of the storage capacitor Cst4*b*. The transistor T24*b* may be referred to as a driving transistor.

In the storage capacitor Cst4*b*, one electrode is connected to the common high voltage line QVDDL, and the other electrode is connected to the gate electrode of the transistor T24*b*.

In the sixth light-emitting diode LD6*b*, the first electrode is connected to the other electrode of the transistor T24*b*, and the second electrode is connected to the common low voltage line QVCOML. The sixth light-emitting diode LD6*b* may be a light-emitting diode of the third color C.

As shown in FIG. 15, only one sixth light-emitting diode LD6*b* is included. However, in other embodiments, the fourth pixel PX4*b* may include a plurality of sixth light-emitting diodes for the third color C. The plurality of sixth light-emitting diodes may be arranged parallel with each other such that each first electrode is connected to the other electrode of the transistor T24*b*, and each second electrode is connected to the common low voltage line QVCOML. The light-emitting diodes may be nano-LEDs.

Figure 16:
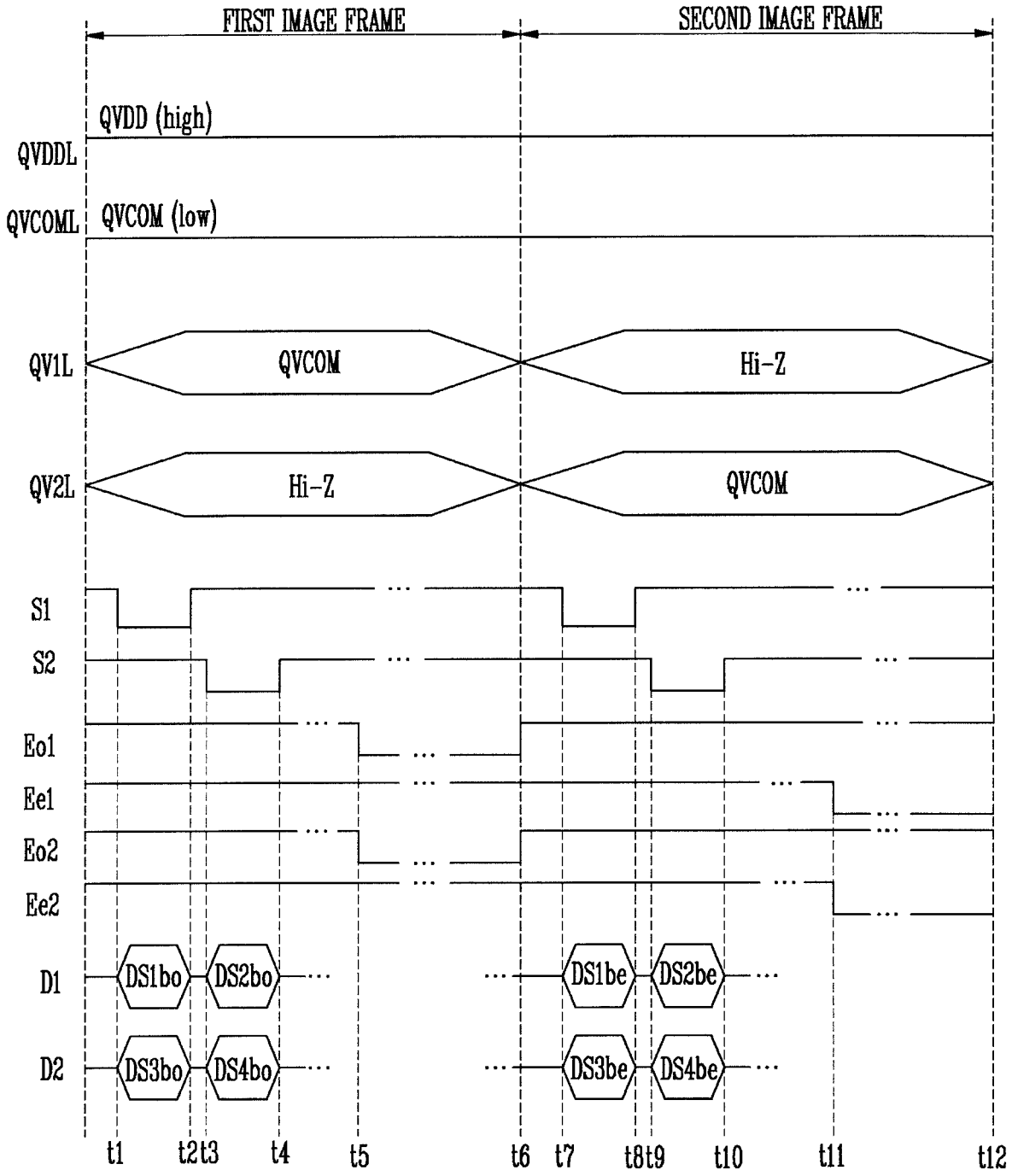
FIG. 16 is a diagram illustrating a driving method of the display device of the second embodiment.

FIG. 16 is a diagram illustrating a driving method of the display device of the second embodiment.

Referring to FIG. 16, in the driving method of the display device 10*b* of the second embodiment, signals for the first pixel group including the first to fourth pixels PX1*b*, PX2*b*, PX3*b*, and PX4*b* will be described. The same or similar description may be applied to pixels of other pixel groups.

First, as mentioned above by referring to FIG. 11, because the first switch SW1 is turned on in the first image frame, the common low voltage QVCOM is applied to the first power voltage line QV1L. Also, because the second switch SW2 is turned off, the second power voltage line QV2L is in the floating state.

The scan signal of the turn-on level (low level) is supplied through the scan line S1 during a period t1 to t2. Thus, the transistor T11*b* of the first pixel PX1*b* is turned on to connect the data line D1 and the other electrode of the storage capacitor Cst1*b*. The storage capacitor Cst1*b* records, or stores, the potential difference between the common high voltage QVDD applied to the common high voltage line QVDDL and the data voltage DS1*bo* applied to the data line D1.

Similarly, during the same period t1 to t2, the transistor T13*b* of the third pixel PX3*b* is turned on to connect the data line D2 and the other electrode of the storage capacitor Cst3*b*. The storage capacitor Cst3*b* records, or stores, the potential difference between the common high voltage QVDD applied to the common high voltage line QVDDL and the data voltage DS3*bo* applied to the data line D2.

Next, the scan signal of the turn-on level (low level) is supplied through the scan line S2 in a period t3 to t4. Thus, the transistor T12*b* of the second pixel PX2*b* is turned on to connect the data line D1 to the other electrode of the storage capacitor Cst2*b*. The storage capacitor Cst2*b* records the potential difference between the common high voltage QVDD applied to the common high voltage line QVDDL and the data voltage DS2*bo* applied to the data line D1.

Similarly, during the same period t3 to t4, the transistor T14*b* of the fourth pixel PX4*b* is turned on to connect the data line D2 and the other electrode of the storage capacitor Cst4*b*. The storage capacitor Cst4*b* records the potential difference between the common high voltage QVDD applied to the common high voltage line QVDDL and the data voltage DS4*bo* applied to the data line D2.

Next, the emission control signal of the turn-on level (low level) is supplied through the first emission control lines Eo1, Eo2, . . . at a time t5. Thus, the first emission control transistor T31*b* of the first pixel PX1*b* is turned on. Because the transistor T21*b* is turned on in accordance with the potential difference recorded in the storage capacitor Cst1*b*, a driving current path through the common high voltage line QVDDL, the transistor T21*b*, the first emission control transistor T31*b*, the first light-emitting diode LD1*b*, and the first power voltage line QV1L is formed. Accordingly, the first light-emitting diode LD1*b* emits light at a grayscale corresponding to the driving current depending on the potential difference recorded in the storage capacitor Cst1*b*. The second light-emitting diode LD2*b* does not emit light because the corresponding driving current path is not formed. Accordingly, the first pixel PX1*b* emits light of the first color A in the first image frame.

Similarly, the first emission control transistor T32*b* of the second pixel PX2*b* is turned on. Because the transistor T22*b* is turned on in accordance with the potential difference recorded in the storage capacitor Cst2*b*, a driving current path through the common high voltage line QVDDL, the transistor T22*b*, the first emission control transistor T32*b*, the fourth light-emitting diode LD4*b*, and the first power voltage line QV1L is formed. Therefore, the fourth light-emitting diode LD4*b* emits light at a grayscale corresponding to the driving current depending on the potential difference recorded in the storage capacitor Cst2*b*. The third light-emitting diode LD3*b* does not emit light because the corresponding driving current path is not formed. Therefore, the second pixel PX2*b* emits light of the second color B in the first image frame.

Because each of the third pixel PX3*b* and the fourth pixel PX4*b* includes only a single-color light-emitting diode, each of the pixels PX3*b* and PX4*b* emits light of the third color C in the first image frame.

At a time t6, the emission control signal of the turn-off level (high level) may be supplied through the first emission control lines Eo1, Eo2, . . . . Therefore, the first pixel PX1*b* and the second pixel PX2*b* do not emit light. However, because the light emissions of the third pixel PX3*b* and the fourth pixel PX4*b* of this embodiment are not separately controlled (e.g., with emission control transistors), they may be in a continuous light emitting state.

Next, as mentioned above by referring to FIG. 11, because the second switch SW2 is turned on in the second image frame, the common low voltage QVCOM is applied to the second power voltage line QV2L. Also, because the first switch SW1 is turned off, the first power voltage line QV1L is in the floating state.

The scan signal of the turn-on level (low level) is supplied through the scan line S1 during the period t7 to t8. Thus, the transistor T11*b* of the first pixel PX1*b* is turned on to connect the data line D1 and the other electrode of the storage capacitor Cst1*b*. The storage capacitor Cst1*b* records the potential difference between the common high voltage QVDD applied to the common high voltage line QVDDL and the data voltage DS1*be* applied to the data line D1.

Similarly, during the same period t7 to t8, the transistor T13*b* of the third pixel PX3*b* is turned on to connect the data line D2 and the other electrode of the storage capacitor Cst3*b*. The storage capacitor Cst3*b* records the potential difference between the common high voltage QVDD applied to the common high voltage line QVDDL and the data voltage DS3*be* applied to the data line D2.

Next, the scan signal of the turn-on level (low level) is supplied through the scan line S2 in the period t9 to t10. Thus, the transistor T12*b* of the second pixel PX2*b* is turned on to connect the data line D1 to the other electrode of the storage capacitor Cst2*b*. The storage capacitor Cst2*b* records the potential difference between the common high voltage QVDD applied to the common high voltage line QVDDL and the data voltage DS2*be* applied to the data line D1.

Similarly, during the same period t9 to t10, the transistor T14*b* of the fourth pixel PX4*b* is turned on to connect the data line D2 and the other electrode of the storage capacitor Cst4*b*. The storage capacitor Cst4*b* records the potential difference between the common high voltage QVDD applied to the common high voltage line QVDDL and the data voltage DS4*be* applied to the data line D2.

Next, the emission control signal of the turn-on level (low level) is supplied through the second emission control lines Ee1, Ee2, . . . at a time t11. Thus, the second emission control transistor T41*b* of the first pixel PX1*b* is turned on. Because the transistor T21*b* is turned on in accordance with the potential difference recorded in the storage capacitor Cst1*b*, a driving current path through the common high voltage line QVDDL, the transistor T21*b*, the second emission control transistor T41*b*, the second light-emitting diode LD2*b*, and the second power voltage line QV2L is formed. Accordingly, the second light-emitting diode LD2*b* emits light at a grayscale corresponding to the driving current depending on the potential difference recorded in the storage capacitor Cst1*b*. The first light-emitting diode LD1*b* does not emit light because the corresponding driving current path is not formed. Accordingly, the first pixel PX1*b* emits light of the second color B in the second image frame.

Similarly, the second emission control transistor T42*b* of the second pixel PX2*b* is turned on. Because the transistor T22*b* is turned on in accordance with the potential difference recorded in the storage capacitor Cst2*b*, a driving current path through the common high voltage line QVDDL, the transistor T22*b*, the second emission control transistor T42*b*, the third light-emitting diode LD3*b*, and the second power voltage line QV2L is formed. Therefore, the third light-emitting diode LD3*b* emits light at a grayscale corresponding to the driving current depending on the potential difference recorded in the storage capacitor Cst2*b*. The fourth light-emitting diode LD4*b* does not emit light because the corresponding driving current path is not formed. Therefore, the second pixel PX2*b* emits light of the first color A in the second image frame.

Because each of the third pixel PX3*b* and the fourth pixel PX4*b* includes only a single-color light-emitting diode, each of the pixels PX3*b* and PX4*b* emits light of the third color C in the second image frame.

At a time t12, the emission control signal of the turn-off level (high level) may be supplied through the second emission control lines Ee1, Ee2, . . . . Therefore, the first pixel PX1*b* and the second pixel PX2*b* do not emit light. However, because the light emissions of the third pixel PX3*b* and the fourth pixel PX4*b* of this embodiment are not separately controlled, they may be in a continuous light emitting state.

The display device according to the present disclosure may reduce or prevent color-breakup while achieving a high resolution because one pixel may include light-emitting elements of a plurality of colors.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims, with functional equivalents thereof to be included.

What is claimed is:

1. A display device comprising:

a plurality of data lines to supply data voltages;

a plurality of scan lines to supply scan signals; and a first pixel connected to at least one of the plurality of data lines, and connected to at least one of the plurality of scan lines, the first pixel comprising:

a first light-emitting diode of a first color, in which a first electrode is connected to a first node and a second electrode is connected to a reference voltage line; and a second light-emitting diode of a second color that is different from the first color, in which a first electrode is connected to the reference voltage line, and a second electrode is connected to the first node, wherein the first pixel is configured to emit light in a first direction and not to emit light in a second direction opposite to the first direction, and wherein a polarity of a first data voltage applied to the first node from a corresponding one of the data lines is alternated in units of image frames with respect to a reference voltage applied to the reference voltage line.

2. The display device of claim 1, further comprising a second pixel connected to at least one of the plurality of data lines, and connected to at least one of the plurality of scan lines, the second pixel comprising:

a third light-emitting diode of the first color, in which a first electrode is connected to a second node, and a second electrode is connected to the reference voltage line; and a fourth light-emitting diode of the second color, in which a first electrode is connected to the reference voltage line, and a second electrode is connected to the second node.

3. The display device of claim 2, wherein a polarity of a second data voltage applied to the second node is alternated in units of the image frames with respect to the reference voltage, and wherein the polarity of the first data voltage and the polarity of the second data voltage are opposite to each other with respect to the reference voltage in units of the image frames.

4. The display device of claim 1, further comprising a second pixel connected to at least one of the plurality of data lines and connected to at least one of the plurality of scan lines, the second pixel comprising:

a third light-emitting diode of the first color, in which a first electrode is connected to the reference voltage line, and a second electrode is connected to a second node; and a fourth light-emitting diode of the second color, in which a first electrode is connected to the second node, and a second electrode is connected to the reference voltage line.

5. The display device of claim 4, further comprising a third pixel connected to at least one of the plurality of data lines, and connected to at least one of the plurality of scan lines, the third pixel comprising a fifth light-emitting diode of a third color that is different from the first color and the second color, in which a first electrode is connected to a third node, and a second electrode is connected to the reference voltage line.

6. The display device of claim 5, wherein a polarity of a second data voltage applied to the second node is alternated in units of the image frames with respect to the reference voltage, and wherein the polarity of the first data voltage and the polarity of the second data voltage are identical to each other with respect to the reference voltage in units of the image frames.

7. The display device of claim 6, wherein a polarity of a third data voltage applied to the third node is identically maintained in units of the image frames with respect to the reference voltage.

8. A display device comprising:

a plurality of data lines to supply data voltages;

a plurality of scan lines to supply scan signals; and a first pixel connected to at least one of the plurality of data lines, and connected to at least one of the plurality of scan lines, the first pixel comprising:

a first emission control transistor comprising one electrode connected to a second power voltage line, the other electrode connected to a fifth node, and a gate electrode connected to a first emission control line; and a second emission control transistor comprising one electrode connected to a first power voltage line, the other electrode connected to the fifth node, and a gate electrode connected to a second emission control line;

a first light-emitting diode of a first color, in which a second electrode is connected to the one electrode of the second emission control transistor, and a first electrode is connected to the one electrode of the first emission control transistor; and a second light-emitting diode of a second color that is different from the first color, in which a second electrode is connected to the one electrode of the first emission control transistor, and a first electrode is connected to the one electrode of the second emission control transistor, wherein the first pixel is configured to emit light in a first direction and not to emit light in a second direction opposite to the first direction.

9. The display device of claim 8, further comprising a second pixel connected to at least one of the plurality of data lines, and connected to at least one of the plurality of scan lines, the second pixel comprising:

a third light-emitting diode of the first color, in which a second electrode is connected to the second power voltage line, and a first electrode is connected to the first power voltage line; and a fourth light-emitting diode of the second color, in which a second electrode is connected to the first power voltage line and a first electrode is connected to the second power voltage line.

10. The display device of claim 9, further comprising a third pixel connected to at least one of the plurality of data lines, and connected to at least one of the plurality of scan lines, the third pixel comprising a fifth light-emitting diode of a third color that is different from the first color and the second color, in which a second electrode is connected to a common low voltage line.

11. The display device of claim 10, wherein the second pixel further comprises:

another first emission control transistor comprising one electrode connected to the second power voltage line, the other electrode connected to the fifth node, and a gate electrode connected to another first emission control line; and another second emission control transistor comprising one electrode connected to the first power voltage line, the other electrode connected to the fifth node, and a gate electrode connected to another second emission control line.

12. The display device of claim 11, wherein each of the first pixel and the second pixel further comprises:

a first transistor comprising one electrode connected to a corresponding data line and a gate electrode connected to a corresponding scan line;

a second transistor comprising one electrode connected to a common high voltage line, the other electrode connected to the fifth node, and a gate electrode connected to the other electrode of the first transistor; and a storage capacitor comprising one electrode connected to the common high voltage line, and the other electrode connected to the gate electrode of the second transistor.

13. The display device of claim 12, wherein when the first transistor is in a turned-on state, the first emission control transistor and the second emission control transistor are in a turned-off state.

14. The display device of claim 11, further comprising:

a first switch to connect the first power voltage line and the common low voltage line; and a second switch to connect the second power voltage line and the common low voltage line.

15. The display device of claim 14, wherein the first switch and the second switch are alternately turned on and off in units of image frames.

16. The display device of claim 15, wherein when the first switch is in a turned-on state, the second switch is in a turned-off state, and vice versa.

17. The display device of claim 11, wherein the first emission control transistor and the second emission control transistor are alternately turned on and off in units of image frames.

18. The display device of claim 17, wherein when the first emission control transistor is in a turned-on state, the second emission control transistor is in a turned-off state, and vice versa.

19. A display device comprising:

a plurality of data lines to supply data voltages;

a plurality of scan lines to supply scan signals; and a first pixel connected to at least one of the plurality of data lines, and connected to at least one of the plurality of scan lines, the first pixel comprising:

a first light-emitting diode of a first color, in which a first electrode is connected to a first node and a second electrode is connected to a reference voltage line; and a second light-emitting diode of a second color that is different from the first color, in which a first electrode is connected to the reference voltage line, and a second electrode is connected to the first node, wherein the first pixel is configured to emit light in a first direction and not to emit light in a second direction opposite to the first direction, and wherein a first data voltage applied to the first node in a first image frame is greater than a reference voltage applied to the reference voltage line, and the first data voltage in a second image frame after the first image frame is less than the reference voltage.

* * * * *